US005360244A

United States Patent [19]

Gleason et al.

[11] Patent Number: 5,360,244

[45] Date of Patent: Nov. 1, 1994

[54] LOCK ASSEMBLY

[75] Inventors: Stephen J. Gleason, Charles City; Marvin L. Larsen, New Hampton, both of Iowa

[73] Assignee: Tri/Mark Corporation, New Hampton, Iowa

[21] Appl. No.: 28,307

[22] Filed: Mar. 9, 1993

[51] Int. Cl.[5] ..... E05C 1/12

[52] U.S. Cl. ..... 292/167; 292/337

[58] Field of Search ..... 292/167, 171, 173, 175, 292/163, 337, DIG. 64

[56] References Cited

U.S. PATENT DOCUMENTS 1,678,982 7/1928 Griffin ..... 292/175 X
1,689,101 10/1928 Beck ..... 292/175
1,831,067 11/1931 Hansen ..... 292/167
1,958,731 5/1934 Voegelein ..... 292/171
2,676,826 4/1954 Smith ..... 292/175

*Primary Examiner*—Rodney M. Lindsey
*Attorney, Agent, or Firm*—Wood, Phillips, VanSanten, Hoffman & Ertel

[57] ABSTRACT

A lock assembly having a housing and a plunger assembly guided for movement relative to the housing between a latched position and an unlatched position with the plunger assembly and housing in assembled relationship. A tab is provided on one of the plunger assembly and housing and is repositionable from an assembly position into a holding position. With the tab in the assembly position, the plunger assembly and housing can be placed in and taken out of, their assembled relationship. In the holding position, the tab maintains the plunger assembly and housing in assembled relationship.

19 Claims, 2 Drawing Sheets

FIG. 1
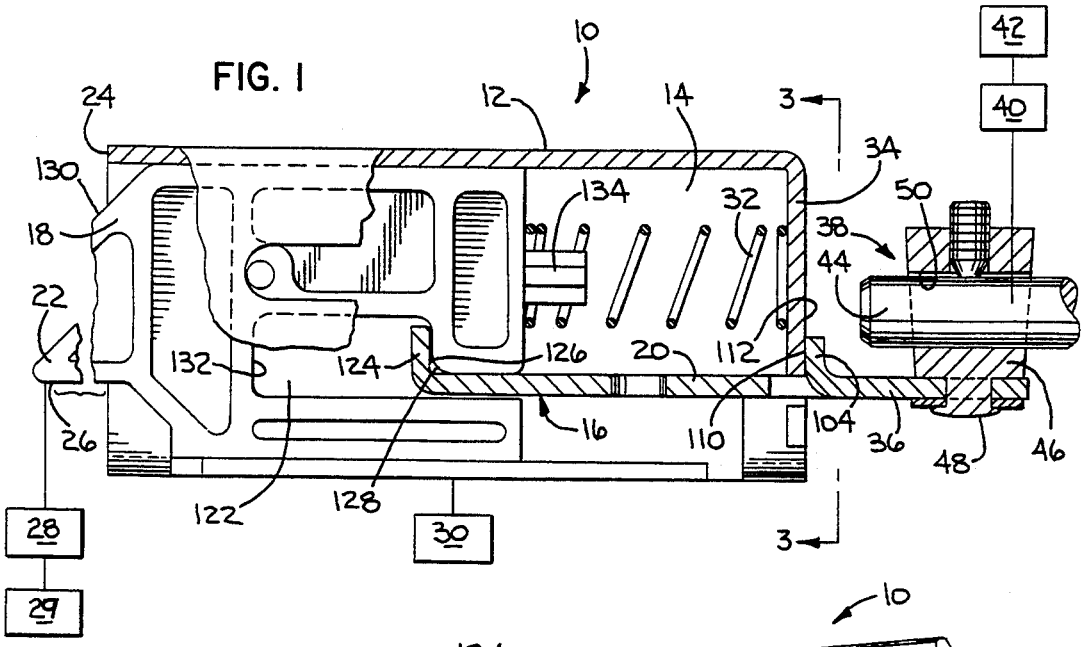
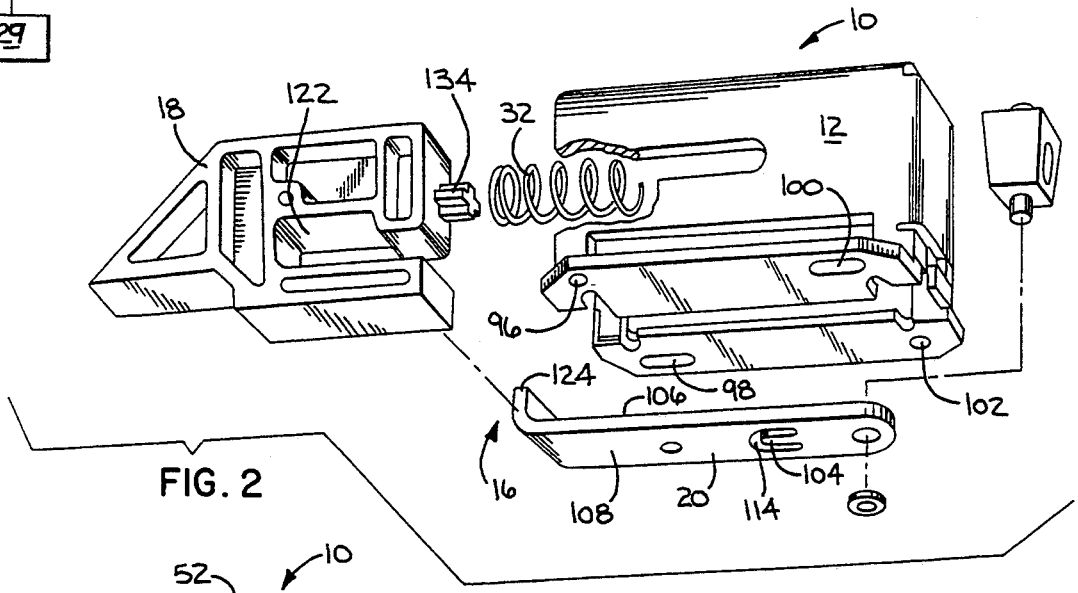
FIG. 2
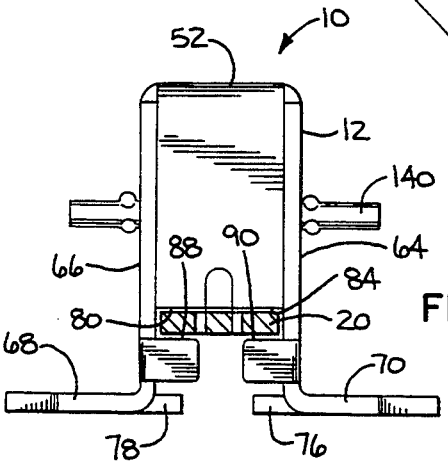
FIG. 3
FIG. 4
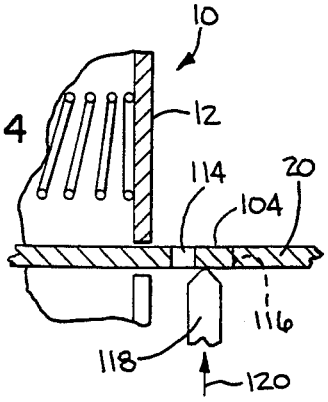

LOCK ASSEMBLY

BACKGROUND OF THE INVENTION

1. Field of the Invention

This invention relates to locks for releasably maintaining a hinged closure in a closed state and, more particularly, to a lock assembly having a plunger that is guidingly moved within a housing between a latched and unlatched position.

2. Background Art

A wide variety of locks/latches are currently present in the art to maintain a hinged closure member in a closed state with respect to a frame to which it is mounted. It is common practice to assemble the lock by providing two separate subassemblies and to operatively interconnect these subassemblies, one each from the opposite sides of the closure.

One exemplary environment for such locks is on doors for travel trailers and motor homes. Typically, the external subassembly is operable by a flat paddle. Operation of the paddle effects repositioning of a plunger from a latched position to an unlatched position on the internal subassembly. Most commonly, pivoting of the paddle is converted into translatory movement of the plunger.

It is desirable to incorporate the plunger into a housing to define a self-contained unit/module in which the plunger is guided by the housing between latched and unlatched positions. Heretofore, various structures have been devised to maintain the plunger and the housing in assembled relationship. Most typically, the plunger is preassembled to the housing after which a separately attached part maintains the plunger captive in assembled relationship with the housing. The extra part(s) might be held in place by fasteners or welded in place.

The need to assemble separate fasteners and/or to carry out the welding step contributes to the complexity of manufacture, which results in an increase in the attendant cost for the locks.

Another problem with the conventional locks is that the construction of some of the interior subassemblies does not lend itself to being actuated from the inside of the closure. While in some applications, this feature is not necessary, it is necessary when the lock is part of a closure, such as a door on a motor home.

A further problem with conventional locks is that it may be difficult with some of these locks to effect mounting on a closure. Separate mounting structure may be provided to connect the housing to the closure. Multiplication of parts, as in most manufacturing processes, increases inventorying problems and complicates manufacture.

A still further problem with conventional locks is that it is often difficult in constructing these locks to maintain all the parts in desired relationship. In most of these locks, a coil spring is used to bias the plunger towards a latched position. The assembler must put the spring in place, which may in itself be a delicate operation, and thereafter complete the assembly to captively hold the plunger and spring within the housing. The spring has a tendency to fall out and may be improperly located if not held in place by the assemblers as the lock is constructed.

SUMMARY OF THE INVENTION

The present invention is specifically directed to overcoming the above-enumerated problems in a novel and simple manner.

According to the invention, a lock assembly is provided having a housing and a plunger assembly guided for movement relative to the housing between a latched position and an unlatched position with the plunger assembly and housing in assembled relationship. A tab is provided on one of the plunger assembly and housing and is repositionable from an assembly position into a holding position. With the tab in the assembly position, the plunger assembly and housing can be placed in, and taken out of, their assembled relationship. In the holding position, the tab maintains the plunger assembly and housing in assembled relationship.

With the inventive structure, it is possible to assemble the housing and plunger and to thereafter simply deform the tab to maintain the plunger assembly and housing in assembled relationship.

To facilitate manufacture, the tab can be formed integrally with the plunger assembly to be deformed between its assembly and holding position. In one form, the element having the tab thereon is cut out around the tab so that there is connection between the tab and element along only one edge about which the tab is bendable.

In one form, the plunger assembly includes a plunger and link, with there being cooperating structure on the plunger and link to allow the plunger and link to be placed into a preassembly position, which is maintained with the plunger assembly and housing in assembled relationship. Exemplary connecting structure is a leg and cooperating slot, one each on the link and plunger.

In one form, the plunger assembly moves in a first line between the latched and unlatched positions therefor and the leg is movable within the slot to effect preassembly of the link and plunger by movement of the leg in a direction transverse to the line of movement of the plunger.

To facilitate formation of the housing, the housing may be defined from a formed piece of sheet metal. In one form, the entire housing is defined by a formed single sheet of metal. The sheet metal can be formed to define a receptacle for guiding movement of the plunger assembly between its latched position and its unlatched positions and a structure for anchoring the housing to a support for the lock assembly.

The plunger is normally biased towards its latched position. This may be accomplished by a coil spring, or the like. The plunger can have a projecting post to accommodate the coil spring for positive location of the spring and facilitated assembly. The post may also cooperate with the housing to limit movement of the plunger with the plunger assembly in the unlatched position.

To facilitate manipulation of the plunger, a pin can be provided on the plunger to project through the housing to be accessible to an operator.

To interconnect the lock assembly with a cooperating operator/actuator the link can be extended to project from a receptacle defined for the plunger by the housing to externally of the housing, with the exposed portion of the link suitable to connect to an appropriate operator.

The invention further contemplates a lock assembly having a plunger assembly and a housing with first and second ends defining a receptacle for guiding movement of the plunger assembly relative to the housing between latched and unlatched positions with the plunger assembly and housing in assembled relationship. There is an opening in the first end of the housing to allow the plunger assembly to be moved into the housing receptacle into assembled relationship for the plunger assembly and housing, in which the plunger assembly projects through the second end of the housing. A structure is repositionable from an assembly position into a holding position and, in its holding position, abuts the housing to prevent the plunger assembly from being moved out of the assembled relationship. With the structure in the assembly position, the plunger assembly can be moved into and out of the housing receptacle.

Accordingly, the assembler can push the plunger into the housing receptacle and thereafter place the repositionable structure into its holding position to complete assembly.

The repositionable structure can be separate from, or defined integrally with, the link on the plunger assembly.

A biasing structure can act between the second end of the housing and the plunger to normally urge the plunger assembly towards its latched position.

BRIEF DESCRIPTION OF THE DRAWINGS

FIG. 1 is a sectional side view of a lock assembly according to the present invention;

FIG. 2 is an exploded perspective view of the lock assembly;

FIG. 3 is an end elevation view of the lock assembly;

FIG. 4 is a fragmentary view of the end of the lock assembly and showing a tab being deformed to maintain the lock assembly parts in assembled relationship.

DETAILED DESCRIPTION OF THE DRAWINGS

Figure 5:
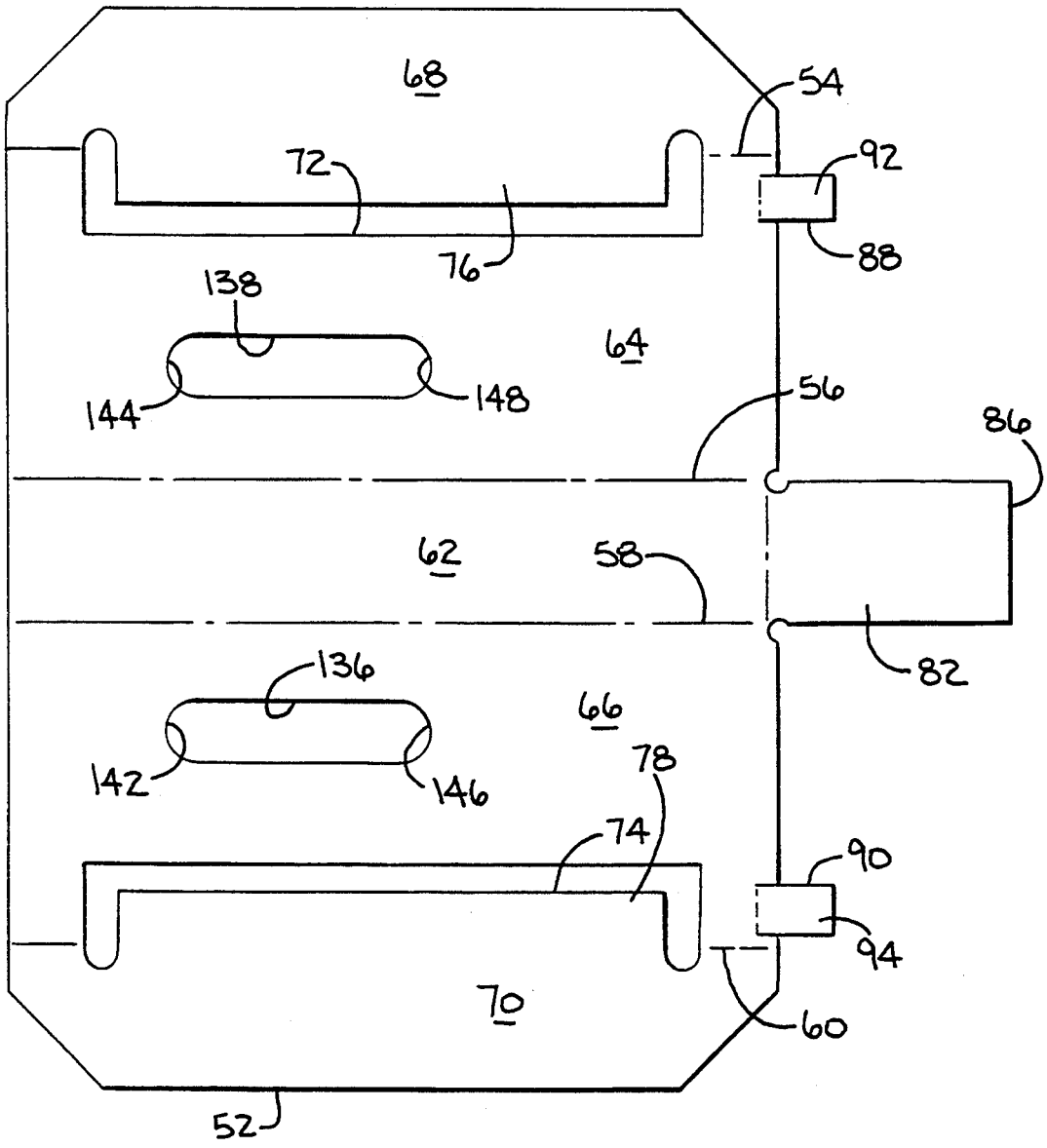
FIG. 5 is a plan view of blank used to form the main housing on the lock assembly.

A preferred form of lock assembly, according to the present invention, is shown at 10 in FIGS. 1–4. The lock assembly 10 has a housing 12 defining a receptacle 14 for a plunger assembly at 16, made up of a plunger 18 and a link 20.

The receptacle 14 has a rectangular cross-sectional configuration that is matched to, and slightly larger than, the shape of the plunger 18. The housing 12 guides movement of the plunger assembly 16 relative to the housing 12 between a latched position and an unlatched position.

The latched position is shown in FIG. 1. In the latched position, the nose 22 of the plunger 18 projects from the housing end 24 so that a surface 26 thereon abuts to a strike plate 28 on a support 29 on which the lock assembly 10 is mounted. Typically, the lock assembly 10 is mounted on a support 30 which will be a hinged closure, such as a door on a storage cabinet, travel trailer of motor home door, etc., and the surface 26 cooperates with the strike plate 28 to maintain the door in a closed state.

A coil spring 32 acts between the plunger 18 and housing end 34 to normally bias the plunger assembly 16 into the latched position therefor.

The link 20 projects from the receptacle 14 to externally of the housing 12. The portion 36 of the link 20 exposed externally of the housing 12 serves as a support for a means at 38 to interconnect the lock assembly 10 to another lock assembly 40. In a typical application, the lock assembly 10 could be mounted on the inside of a mobile home door with the external lock assembly 40 including a paddle-type operating handle 42. Operation of the handle 42 effects translatory movement of a drive rod 44 to thereby move the plunger assembly 16 from its latched position into its unlatched position. A mounting block 46 is rotatably attached to the link portion 36 through a rivet 48 and has a through bore 50 to receive the rod 44.

One aspect of the present invention is the facilitated construction of the housing 12 as well as the facilitated assembly of the entire lock assembly 10. The housing 12 is formed from a sheet metal blank 52, shown in its unformed state in FIG. 5. The blank 52 has a generally rectangular configuration. The blank 52 is configured to be bent along four substantially parallel fold lines 54, 56, 58, 60.

The center portion 62 of the blank 52 defines the upper wall of the housing 12. The opposite side walls 64, 66 are folded relative to the top wall 62 about the fold lines 56, 58, respectively. The walls 64, 66 are substantially parallel to each other and at right angles to the top wall 62.

Anchoring walls 68, 70 are in turn folded at fight angles to the walls 64, 66 about the fold lines 54, 60, respectively. U-shaped cut-outs 72, 74 are defined in the blank 52 in coincidence with the fold lines 54, 60 and are shaped so that flaps 76, 78 on the walls 68, 70 project in cantilever fashion inwardly towards each other to cooperatively define a bottom wall that bounds the receptacle 14.

To define a guide slot 80 for the link 20 projecting through the housing 12, the center wall 62 is extended to define an end flap 82. The top edge 84 of the guide slot 80 is defined by the free end 86 of the flap 82. With the flap 82 folded downwardly between the side walls 64, 66. The bottom edge of the guide slot 80 is defined cooperatively by the upper edges 88, 90 on two flaps 92, 94 integrally formed with, and projecting from, the side walls 64, 66. The flaps 92, 94 are bent inwardly towards each other.

It can be seen that through a simple forming operation, the housing 12 can be formed from a single piece of sheet metal. The anchoring flaps 68, 70 can be provided with bores 96, 98, 100, 102 to accommodate fasteners (not shown) to anchor the housing 12 to the support 30.

With the above arrangement, the housing 12 permits the plunger assembly 16 to be directed through the open housing end 24 into assembled relationship with the housing 12. By directing the plunger assembly 16 from left to right in FIG. 1, the link 20 is aligned with the guide slot 80 in the end wall 82 on the housing 12 so that the link 20 can be projected therethrough.

To prevent the plunger assembly 16 from being drawn out of its assembled relationship with the housing 12, a repositionable, U-shaped tab 104 is provided on the link portion 36. The link 20 shown is preferably made from a metal material that has a flat configuration with oppositely facing, parallel surfaces 106, 108. With the tab 104 in an assembly position, the tab 104 does not project from the space bounded by the surfaces 106, 108. The tab 104 is placed in a holding position by bending the tab to the configuration shown in FIG. 1. With the tab 104 in the holding position, a surface 110 thereon abuts the external surface 112 of the end wall 34 with the plunger assembly 16 in the latched position.

To facilitate deformation of the tab 104, the link 20 is provided with a corresponding, U-shaped cut-out 114. This results in the connection of the tab 104 to the remainder of the link along only an edge 116 about which the tab 104 is bendable between its assembly position and its holding position.

In FIG. 4, a tool 118 is shown to be pressed upwardly in the direction of the arrow 120 to effect deformation of the tab 104. The tab 104 could be directed downwardly to accomplish the same purpose.

The plunger 18 is preassembled to the link 20. The plunger 18, which is preferably made from plastic, has a slot 122 formed therethrough. The link 20 has an offset leg 124 for reception in the slot 122. The leg 124 is introduced into the slot 122 by relative sideward movement between the plunger 18 and link 20. The leg 124 has a surface 126 that abuts to a wall 128 bounding the slot 122. By urging the link 20 to the right in FIG. 1, the surface 126 bears on the wall 128 to move the plunger assembly 16 from its latched position to its unlatched position.

With the lock assembly 10 in its latched position, the plunger 18 can be moved to the unlatched position without repositioning the link 20. For example, as the support 30 is closed, a ramp surface 130 on the plunger 18 is cammed by the strike plate 28 to urge the plunger 18 from left to right in FIG. 1 out of the latched position and into the unlatched position. The slot 122 has sufficient length that the plunger 18 will be fully in the unlatched position before the opposite slot end 132 encounters the leg 124.

To facilitate assembly of the spring 32, a post 134 is integrally formed with, and projects in cantilever fashion from, the plunger 18. The spring 32 can be placed over the post 134 at the initiation of assembly to keep the spring 32 in place on the plunger 18 at the desired location. The post 134 can also be constructed to limit the plunger assembly 16 moving from its latched position into its unlatched position by abutting the housing wall 82.

To construct the lock assembly 10, the housing 12 is pre-bent to the configuration in FIGS. 1–4. The link 20 is preassembled to the plunger 18 by directing the leg 124 thereon into the slot 122 on the plunger 18 to define the plunger assembly 16. The spring 32 is directed over the post 134. The plunger assembly 16, with the spring 32 thereon, is then directed from left to right in FIG. 1 through the open end of the housing 24. The plunger assembly 16 is advanced to project the link 20 through the opposite housing end 34 sufficiently that the tab 104 is fully exposed externally of the housing 12, compressing the spring 32 in the process. The tab 104 is then bent into its holding position so that the plunger assembly 16 and housing 12 are maintained in assembled relationship.

To facilitate manual operation of the plunger 18, oval cut-outs 136, 138 are defined in the side walls 64, 66. A pin 140 projects through the plunger 18 and is exposed through the slots 136, 138 at the sides of the housing 12 to be engaged by the operator. By grasping the pin 140, the operator can slide the plunger 18 between the latched and unlatched position. The slots 136, 138 axe configured so as to allow the plunger 18 to move fully between its latched and unlatched position.

The slots 136, 138 can be configured so that the ends 142, 144 abut the pin 140 to arrest movement of the plunger 18 as it realizes its latched position. The abutment of the pin 140 to the slot ends 142, 144 can be simultaneous with the abutment of the tab 104 to the housing 12. While it is not necessary, the opposite slot ends 146, 148 can abut the pin 140 to prevent movement of the plunger 18 from its latched position beyond a predetermined point in its unlatched position.

The foregoing disclosure of specific embodiments is intended to be illustrative of the broad concepts comprehended by the invention.

We claim:

1. A lock assembly comprising:

a plunger assembly;

a housing;

first means cooperating between the plunger assembly and housing for guiding relative movement of the plunger assembly and housing between a) a latched position and b) an unlatched position with the plunger assembly and housing in assembled relationship;

second means on one of the plunger assembly and housing for engaging the other of the plunger assembly and housing and maintaining the plunger assembly and housing in assembled relationship, said second means comprising a tab on the one of the plunger assembly and housing that is repositionable from an assembly position into a holding position, there being a cut-out around at least a portion of the tab, said tab in said assembly position allowing the plunger assembly and housing to be placed in assembled relationship, said tab in said holding position maintaining the plunger assembly and housing in assembled relationship, said housing comprising a single piece of sheet metal that defines a) a receptacle for guiding movement of the plunger assembly between its latched position and its unlatched position and b) a means for anchoring the housing to a support for the lock assembly.

2. The lock assembly according to claim 1 wherein the sheet metal piece defines an end on the housing and there are means acting between the housing end and the plunger assembly for normally urging the plunger assembly toward its latched position.

3. The lock assembly according to claim 1 wherein the plunger assembly comprises a plunger and a link, there being third means cooperating between the link, plunger and housing to allow the link and plunger to be moved from a completely separated position to a pre-assembly position and maintained in the pre-assembly position with the plunger assembly and housing in assembled relationship.

4. The lock assembly according to claim 3 wherein the third means comprises a leg and cooperating slot, one each on the link and plunger.

5. The lock assembly according to claim 4 wherein the plunger assembly moves in a first line between the latched and unlatched positions and the leg is movable into the slot only by movement of the leg in a second direction that is transverse to the first line.

6. The lock assembly according to claim 3 wherein the housing defines a receptacle within which the plunger assembly is guided as the plunger assembly moves between its latched and unlatched positions and the link projects from the receptacle through the housing to define an exposed portion to be operatively connected to a means for operating the lock assembly.

7. The lock assembly according to claim 1 wherein the tab is deformable between its assembly and holding positions.

8. The lock assembly according to claim 7 wherein there is a biasing means acting between the housing and plunger assembly for normally urging the plunger assembly toward its latched position.

9. The lock assembly according to claim 1 wherein the plunger assembly includes a plunger and a link, the plunger has a projecting post and a coil spring surrounds the post and acts between the housing and plunger to normally urge the plunger assembly towards its latched position.

10. The lock assembly according to claim 1 wherein the plunger assembly includes a plunger and a link and a pin projects from the plunger through the housing to be accessible to an operator to move the plunger through the pin from its latched position into its unlatched position.

11. A lock assembly comprising:

a plunger assembly:

a housing having first and second ends and defining a receptacle for guiding movement of the plunger assembly relative to the housing between a) a latched position and b) an unlatched position with the housing and plunger assembly in assembled relationship, there being an opening in the first end of the housing to allow the plunger assembly to be moved into the housing receptacle into assembled relationship in which a portion of the plunger assembly projects through the second end of the housing; and means on the plunger assembly portion that is repositionable from an assembly position into a holding position, said plunger assembly being movable into and out of the housing receptacle with the repositionable means in its assembly position, said repositionable means in its holding position abutting the housing to prevent the plunger assembly from being moved out of assembled relationship with the housing, wherein the plunger assembly comprises a link and a plunger and the repositionable means comprises a tab on the link that is movable between the assembly and holding positions therefor.

12. The lock assembly according to claim 11 wherein the tab is integrally formed as one piece with the link.

13. A lock assembly comprising:

a plunger assembly;

a housing having first and second ends and defining a receptacle for guiding movement of the plunger assembly relative to the housing between a) a latched position and b) an unlatched position with the housing and plunger assembly in assembled relationship, there being an opening in the first end of the housing to allow the plunger assembly to be moved into the housing receptacle into assembled relationship in which a portion of the plunger assembly projects through the second end of the housing; and means on the plunger assembly portion that is repositionable from an assembly position into a holding position, said plunger assembly being movable into and out of the housing receptacle with the repositionable means in its assembly position, said repositionable means in its holding position abutting the housing to prevent the plunger assembly from being moved out of assembled relationship with the housing, wherein the plunger assembly comprises a flat link with spaced ends and the repositionable means resides between the ends of the flat link.

14. The lock assembly according to claim 13 wherein the housing comprises a single piece of sheet metal that defines a) the receptacle and b) a means for anchoring the housing to a support for the lock assembly.

15. The lock assembly according to claim 13 wherein there are means in addition to the link assembly projecting through the housing that is accessible in an operation to move the plunger assembly from its latched position into the unlatched position.

16. The lock assembly according to claim 13 wherein the plunger assembly comprises a plunger and there is a biasing means acting between the second end of the housing and the plunger for normally urging the plunger assembly towards its latched position.

17. The lock assembly according to claim 13 wherein the plunger assembly comprises a plunger, the plunger assembly is movable substantially in a line between its latched and unlatched positions and there are means cooperating between the plunger and link for placing the plunger and link in a preassembly position only by relative movement of the link and plunger in a direction transverse to the first line.

18. The lock assembly according to claim 13 wherein the housing is defined by a formed piece of sheet metal.

19. A lock assembly comprising:

a plunger assembly;

a housing;

first means cooperating between the plunger assembly and housing for guiding relative movement of the plunger assembly and housing between a) a latched position and b) an unlatched position with the plunger assembly and housing in assembled relationship;

second means on one of the plunger assembly and housing for engaging the other of the plunger assembly and housing and maintaining the plunger assembly and housing in assembled relationship, said second means comprising a tab on the one of the plunger assembly and housing that is repositionable from an assembly position into a holding position, said tab in said assembly position allowing the plunger assembly and housing to be placed in assembled relationship, said tab in said holding position maintaining the plunger assembly and housing in assembled relationship, wherein the tab is deformable between its assembly and holding positions, wherein the plunger assembly includes a link and a plunger and the link is cut out to define the tab which is bendable along an edge relative to the link to be placed into its holding position.

* * * * *